US006237885B1

(12) United States Patent
Mitchell

(10) Patent No.: US 6,237,885 B1
(45) Date of Patent: May 29, 2001

(54) WINDOW COVERING CORD TIE-DOWN DEVICE WITH SIDE CLIPS

(76) Inventor: Howard Scott Mitchell, 1800 Muledeer Run., Leander, TX (US) 78641

( * ) Notice: Subject to any disclaimer, the term of this patent is extended or adjusted under 35 U.S.C. 154(b) by 0 days.

(21) Appl. No.: 09/394,786

(22) Filed: Sep. 13, 1999

Related U.S. Application Data

(63) Continuation of application No. 09/014,371, filed on Jan. 27, 1998.

(51) Int. Cl.[7] ..... A47B 96/06

(52) U.S. Cl. ..... 248/205.4; 248/205.1; 248/363; 248/683

(58) Field of Search ..... 248/205.1, 205.5, 248/205.6, 206.1, 206.2, 206.3, 206.4, 309.3, 362, 363, 467, 683; 242/400.1, 404, 405.1; 160/319, 178.1 R, 178.2 R

(56) References Cited

U.S. PATENT DOCUMENTS 1,859,594 * 5/1932 Meyer et al. ..... 248/206.3
2,647,643 * 8/1953 Cruikshank ..... 211/100
3,174,536 * 3/1965 Francis ..... 160/369
3,291,094 * 12/1966 Beebe ..... 114/218
4,348,012 * 9/1982 Hough ..... 242/85.1
5,039,046 * 8/1991 Brewster ..... 248/206.3
5,087,005 * 2/1992 Holoff et al. ..... 248/205.8
5,328,434 * 7/1994 Carroll ..... 482/140
5,348,240 * 9/1994 Carmo et al. ..... 242/401
5,465,776 * 11/1995 Mirza ..... 160/368.1
5,595,364 * 1/1997 Protz, Jr. ..... 248/205.5
5,613,457 * 3/1997 Frank et al. ..... 114/218
5,806,816 * 9/1998 Hull et al. ..... 248/205.6
5,893,543 * 4/1999 Emery et al. ..... 248/205.5

* cited by examiner

*Primary Examiner*—Leslie A. Braun
*Assistant Examiner*—Walter Landry
(74) *Attorney, Agent, or Firm*—Rick B. Yeager

(57) ABSTRACT

This window covering cord tie-down device permits a cord to be wrapped out of reach of a small child or pet. The preferred embodiment includes a base with two cleats to enable the wrapping of a window covering cord, two suction cups for holding the device in place on a glass window pane, and two side clips to prevent the cord from unraveling. The key aspects of the invention include a removable, reusable, and universal cord tie-down device that is hidden when the window covering is lowered and is neat in appearance and relatively unobtrusive when the covering is raised; that can be mounted directly on a glass window pane without the need for tools; and that effectively secures the window cord.

4 Claims, 6 Drawing Sheets

WINDOW COVERING CORD TIE-DOWN DEVICE WITH SIDE CLIPS

CROSS-REFERENCE TO RELATED APPLICATIONS

This application is a continuation of application Ser. No. 09/014,371 filed Jan. 27, 1998, entitled "Window Covering Cord Tie-Down Device" filed by Applicant. That application is pending at the time of the filing of this application.

BACKGROUND—FIELD OF THE INVENTION

This invention relates to the window coverings industry, specifically to products and methods of keeping window blind or shade cords out of the reach of children.

BACKGROUND—DESCRIPTION OF PRIOR ART

An object of the present invention is to provide a novel form of retaining window covering cords, such as window blind cords and window shade cords, out of the reach of small children.

The key aspects of the invention include a removable, reusable, and universal cord tie-down device that is hidden when the window covering is lowered and is neat in appearance and relatively unobtrusive when the covering is raised; that has side clips to prevent unraveling of the cord; and that can be mounted directly on a glass window pane without the need for tools.

According to the U.S. Consumer Product Safety Commission in its news release No. 97–136, approximately 359 children died in the United States from 1981 through 1985 from strangulation in window covering cords. Those deaths occurred at a rate of approximately one child every two weeks. The window coverings industry has taken steps to produce safer cords, however, no one has devised a completely acceptable method of keeping the cords away from children. If a cord can be handled by a child, then the cord presents a danger regardless of the safety precautions taken by the industry. Most cords are safely out of reach when the blinds or shades are down. The problem arises when they are raised. The length of the cords increases dramatically in the raised position. Small children can become entangled in this excess cord.

The window coverings industry recommends three basic methods of keeping cords out of children's reach.

One recommendation is to use cord cleats. The cleats are typically of the same general shape, but smaller, than the cleats used on the sides of motorboats and sailboats to secure tie ropes. The cleats are designed to be screwed into the wall adjacent to the window. Some manufacturers package these cleats with their blinds and shades, along with the instructions to attach the cleats approximately 6" to 12" apart on the wall adjacent to the cord. The object of the cleats is to provide a place to wrap excess cord around them, typically in a FIG. 8 fashion.

The use of these cleats has several disadvantages. One disadvantage is that the cleats are unsightly, and many homeowners do not want them installed, especially in the more decorative rooms of the home.

Another disadvantage is that special tools or procedures, including drilling, pre-drilling into metal, or screwing the cleats into the wall, are required for installing the cleats. Since most professional installers in the window coverings industry are paid a set price per blind, the installation of the cleats requires additional work but does not offer additional pay for the installer. Therefore, many cleats are never installed by professional installers. In cases where the homeowner installs their blinds themselves without the use of a professional installer, the cleat installation is still a disadvantage because it requires the homeowner will have more work to perform.

Another disadvantage is that the cleats require permanent installation and cannot be moved or stored when not in use.

A further disadvantage to cleats is that, to be effective, the cleats have to be installed on every window in the home which has a blind and cord that kids can reach.

A second recommendation is to use a cord clip device with instructions that the user clip the cord to itself using a clip or other clamping device.

A third recommendation is to provide instructions to wrap or to tie the cord to itself.

The second recommendation and the third recommendation are simply recommendations to the consumer on how to rig their blinds to keep cords out of reach. This rigging does not include a specific product or mechanism.

These methods are primitive and unreliable, and also have disadvantages. Many consumers may not tie the cord effectively, in which case it could fall down and present a danger. On the other hand, if the cord is tied well, then it may become knotted or tangled and difficult to untie. When the cords are tied or clamped in the suggested manner, the cords will appear non-uniform or unsightly. A further disadvantage to the tie or clamp techniques is that consumers could damage the cords with repeated clipping, clamping, or tying.

The prior art indicates cord devices that are more complicated than the present invention. U.S. Pat. No. 5,354,011 which issued Oct. 11, 1994 to Rozon describes a rotary driven spool device for cord retraction. In U.S. Pat. No. 5,676,188 which issued Oct. 14, 1997 to Cadorette, a counter weighted apparatus is described. These devices are complicated and relatively expensive.

For the foregoing reasons, there is a need for a simple, low cost, cord tie-down device.

The prior art includes clamping assemblies using suction cups, such as in U.S. Pat. No. 5,135,206 to Martinez, U.S. Pat. No. 3,207,503 to Clover, and U.S. Pat. No. 3,770,529 to Wagreich. The prior art also includes suction cup assemblies for attaching objects, such as in U.S. Pat. No. 5,087,005 which issued Feb. 11, 1992 to Holoff, U.S. Pat. No. 4,944,548 to Payne, U.S. Pat. No. 5,692,331 to Tipke, U.S. Pat. No. 5,802,729 to O'Brien, U.S. Pat. No. 5,465,776 to Mirza and U.S. Pat. No. 3,896,832 to Montoya. These devices are not specifically designed for child safety or for securing window covering cords. None of the prior art devices include a means for restricting a window cord to prevent unraveling. Nor do any of the prior art devices include a means for wrapping a window cord.

Accordingly, several objects and advantages of the invention are to provide a device specifically designed to be used as a tie-down for window cords that is clear and obscure when mounted on a clear pane of glass; to provide a tie-down mechanism that installs conveniently and rapidly without the need for tools; to provide a tie-down mechanism that can be easily removed and stored when not in use; to provide a tie-down mechanism that is portable and can be moved from one window to another when in need; to provide a tie-down mechanism which does not require the homeowner to "tie" their window cords; to provide a tie-down mechanism which is neat and uniform in appearance; and to provide a tie-down device that effectively secures a window cord and prevents the cord from unraveling.

Further objects and advantages are to provide a tie-down mechanism that is universal. One mechanism can be moved around to any window of the home when needed. Also, the mechanism can be hidden from view without removal if the blind or shade is lowered. An additional advantage with the preferred embodiment is that the device can be mounted and used with only one hand, rather than requiring both bands.

In this description, terms such as top, and clockwise are intended for illustration and explanation only, and the device can be utilized in any orientation. The examples shown include common techniques for which those skilled in the art recognize interchangeability of other elements. Many other variations, modifications and applications of the illustrated embodiments of the invention will be apparent to those skilled in the art.

BRIEF DESCRIPTION OF THE DRAWINGS

These and other features, aspects, and advantages of the present invention will become better understood with regard to the following description, appended claims, and accompanying drawings where:

SUMMARY

In accordance with the preferred embodiment of the present invention, a window cord tie-down device comprises a flat, elongated base having a pair of cleats attached on top of the base, two side clips to prevent unraveling attached on top of the base, and a pair of suction cups temporarily attached on the bottom of the base approximately consistent with the spacing of the cleats. The cord tie-down device is typically attached temporarily to a glass window pane to provide a support for wrapping and holding a window cord out of the reach of small children.

DESCRIPTION OF THE PREFERRED EMBODIMENT

This application is a continuation of application Ser. No. 09/014,371, entitled "Window Covering Cord Tie-Down Device" filed by Applicant. That application is pending at the time of the filing of this application.

Figure 1:
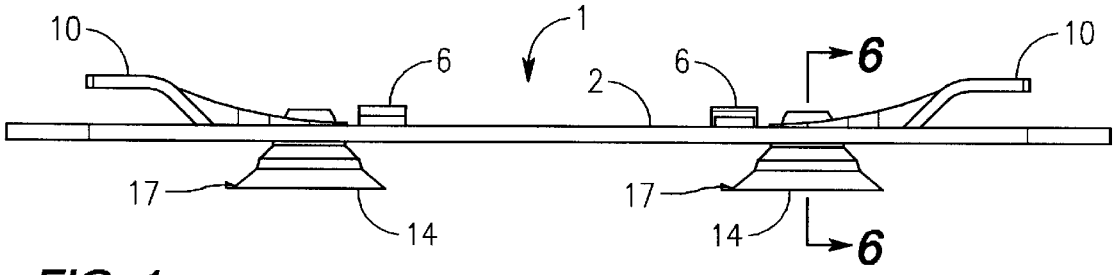
FIG. 1 is a side view of the preferred embodiment.

Referring to FIG. 1 which is a side view of the preferred embodiment, the tie down device 1 has a thin, elongated rectangular base 12, preferably made from clear material such as acrylic. This material is available at most plastics retailers. Although acrylic is the preferred material, other plastics, wood, or metal may be used. Suction cups 14, each having a release tab 17, are affixed to the base 12. Once affixed, the suction cups 14 are located just inside the portion of the base 12 where the cleats 10 rise from the base 12. Two cleats 10 are integral to the base 12 and two side clips 6 are also integral to the base 12. In the preferred embodiment, the cleats 10, side clips 6, and the base 12 are formed separately from the suction cups 14 in a single production step such as injection molding. Alternatively, the two cleats 10 and the side clips 6 may each be attached to the base using an adhesive designed for acrylic which is readily available at hardware stores or plastics companies.

Figure 2:
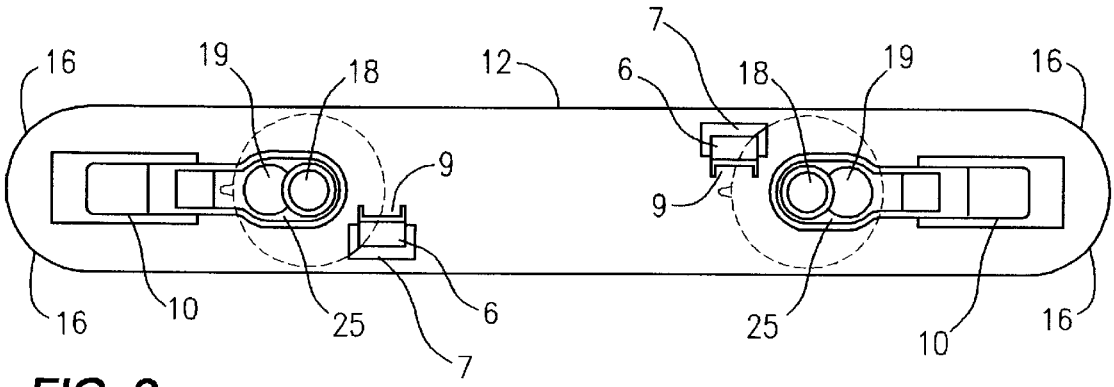
FIG. 2 is a top view of the preferred embodiment.

Referring now to FIG. 2, which is a top view of the preferred embodiment, two cleats 10 are integral to the base 12. The base is long and rectangular with the outer four corners 16 of the base 12 being rounded to avoid snagging and personal injury. In the preferred embodiment, the base is about 7.5 inches long, 1.25 inches wide, and 0.125 inch thick, however, the mechanism can be made effectively using a variety of dimensions. The cleats typically have a length of 1 to 2.5 inches, and a width of about 0.375 inches. The preferred cleat size is a length of about 2 inches, and the cleats are preferably centered on the base a distance of about 1 inch from each end so that a cleat end is aligned with the edge of the base. This configuration is not structurally significant, but has been selected for its appearance. The cleats are preferably made of clear acrylic; however, cleats of other materials will also work. Clear acrylic cleats are available through most window covering fabricators, and from other sources. Beneath each cleat 10 is a cleat opening that is typically approximately 1 inch in length and 0.5 inches in width. This cleat opening decreases the amount of material required for the device and therefore reducing production costs.

The side clips 6 are integral to the base 12 and are designed to restrict the movement of the cord and prevent the window cord from unraveling when the window cord is wrapped around the cleats 10. Each side clip typically has a length of about 0.375 inches and a width of 0.375 inches. Beneath the side clip is a side clip opening 7 which is typically about 0.5 inches in length and 0.25 inches in width. This side clip opening 7 decreases the amount of material required for the device and therefore decreases production costs. The side clip base 9 is located toward the center of the length of the device base 12 just inside of the side clip opening 7. Like the cleats 10, the side clips 6 are preferably made of clear acrylic; however, side clips of other materials will also be suitable. Suction cup openings 18 and 19 are located in a recess 25 of the base 12 so that the suction cup may be affixed to the base using the openings.

Figure 3:
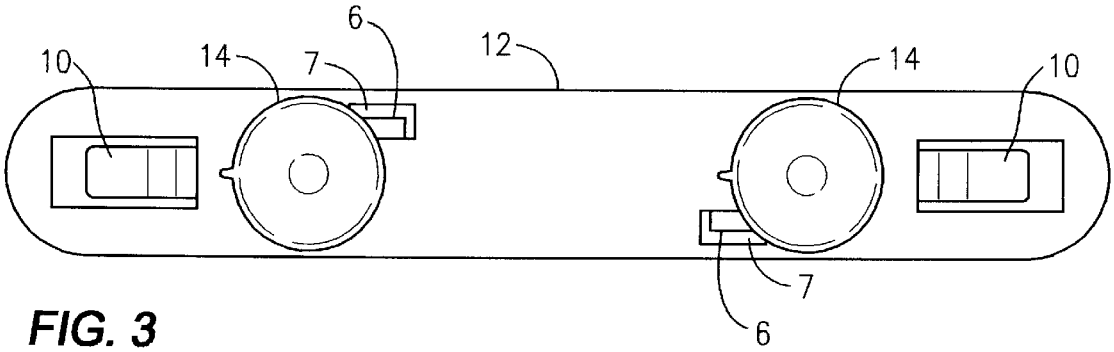
FIG. 3 is a bottom view of the preferred embodiment.

Referring now to FIG. 3 which is a bottom view of the preferred embodiment, two suction cups 14 are affixed on the bottom of the base 12. The suction cups 14 are available at hardware or craft stores and are preferably made of a clear, pliable or rubberized material. Many sizes of suction cups will suffice, however, the cups are preferably not wider than the chosen width of the base 10 for appearance sake. In the preferred embodiment, suction cups with a diameter of about 1.25" are used. Cups with a diameter of 1" have also been used effectively, and have held in place on glass window panes for several months. In accordance with the preferred embodiment, the suction cups 14 may be detached from the base 10 when the device 1 is not being used. Alternatively to detachable suction cups which are attached by insertion, the suction cups may be attached to the base using the same adhesive used to attach the cleats to the base.

Figure 4:
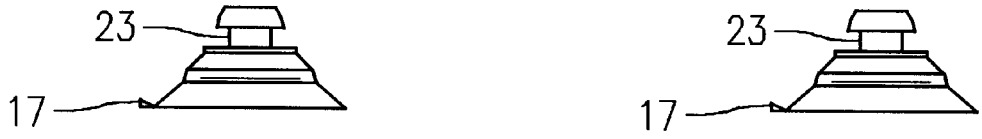
FIG. 4 is a detail of the suction cup and release tab.

Referring now to FIG. 4, a detail of the suction cup and release tab, the preferred suction cups will have a release tab 17 on the outside perimeter of the suction cup such that the user may pull the tab in order to break the vacuum of the suction cup and more easily remove the device. The preferred suction cups will also have a groove 23 located beneath the head of the suction cup on the opposite side of the suction cup from the cup portion. The suction is attached to the base by inserting the groove 23 into the larger suction cup opening and the larger suction cup opening is large enough so that the groove is not tightly secured inside, but small enough so that the head of the suction cup does not pass through the larger suction cup opening. The groove is then slid to the smaller suction cup opening. The smaller suction cup opening is sized such that the groove 23 of the suction cup may be tightly secured within the smaller suction cup opening, thus securing the suction cup to the base.

Figure 5:
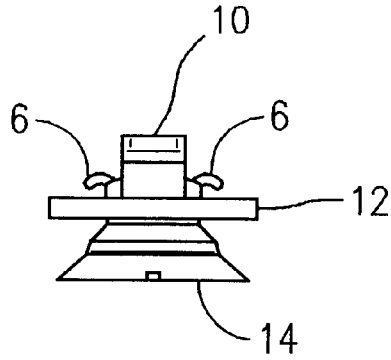
FIG. 5 is another side view of the preferred embodiment.

Referring now to FIG. 5, another side view of the preferred embodiment, each side clip 6 rises to a height of about 0.25 inches over the base 12. Each cleat 10 has a height from the base of about 0.25 inches. The side clips 6 are located just outside each cleat so that a window cord may be wrapped around a cleat and through a side clip.

Figure 6:
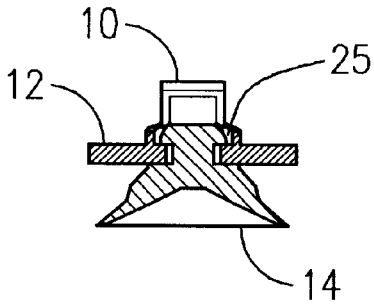
FIG. 6 is a top view of the recessed suction cup opening of the preferred embodiment.
Figure 7A:
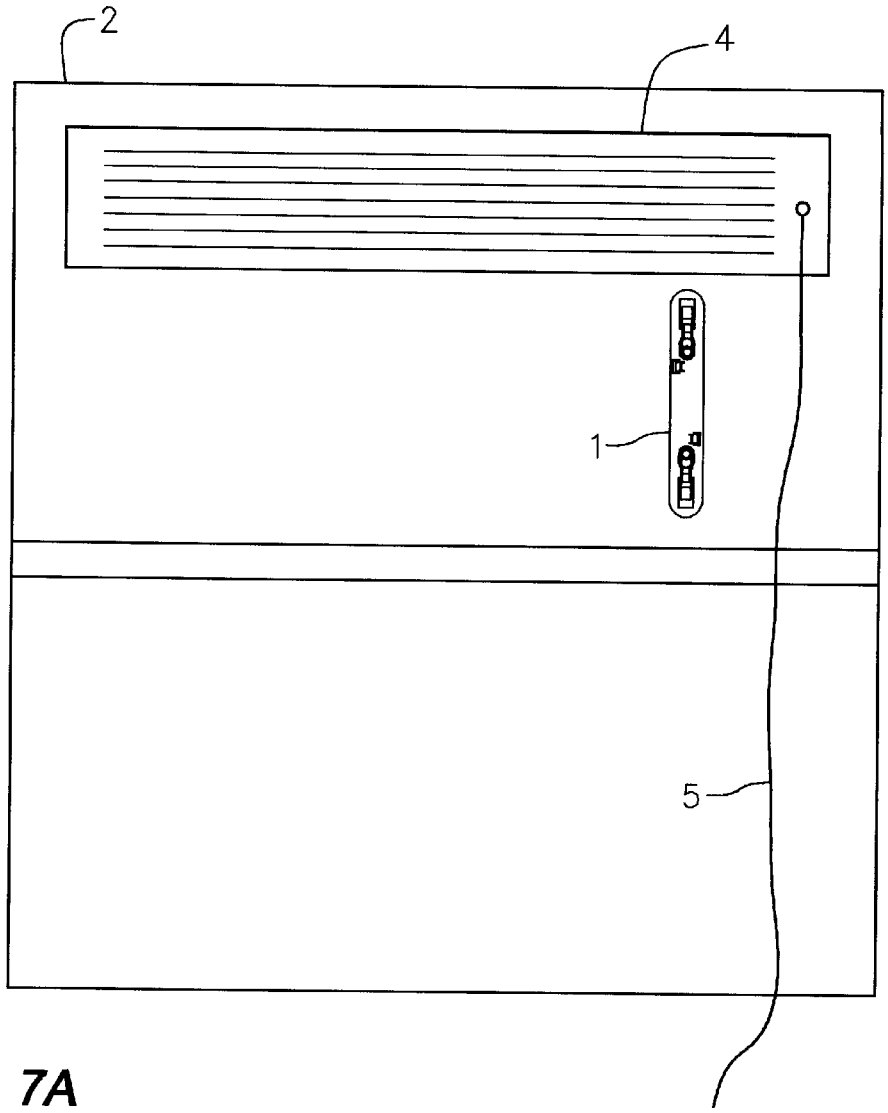
FIG. 7 is a sketch of the preferred cord wrapping procedure.
Figure 7B:
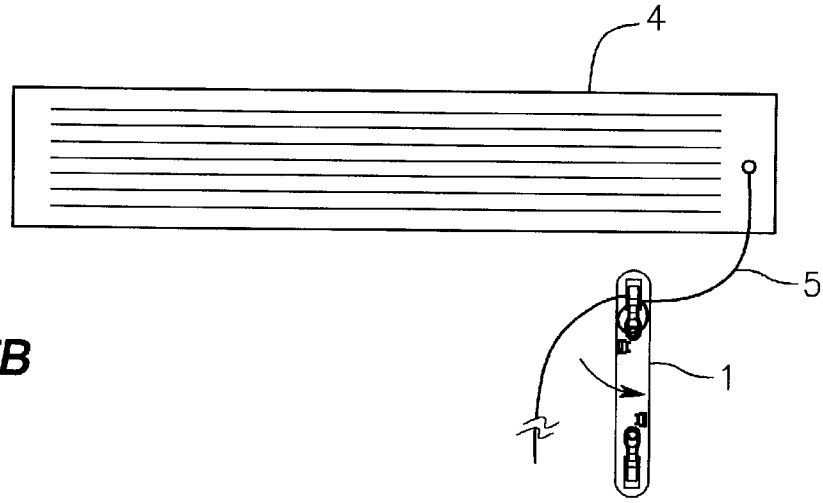
Figure 7C:
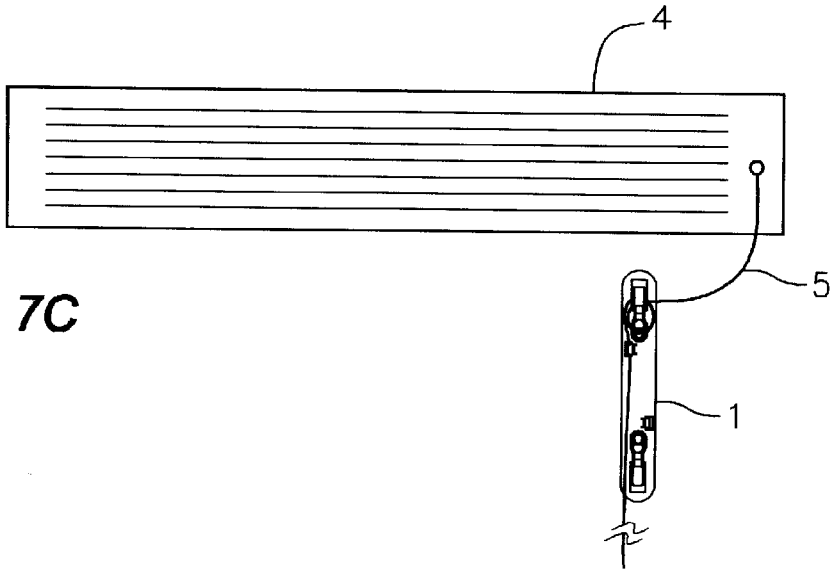
Figure 7D:
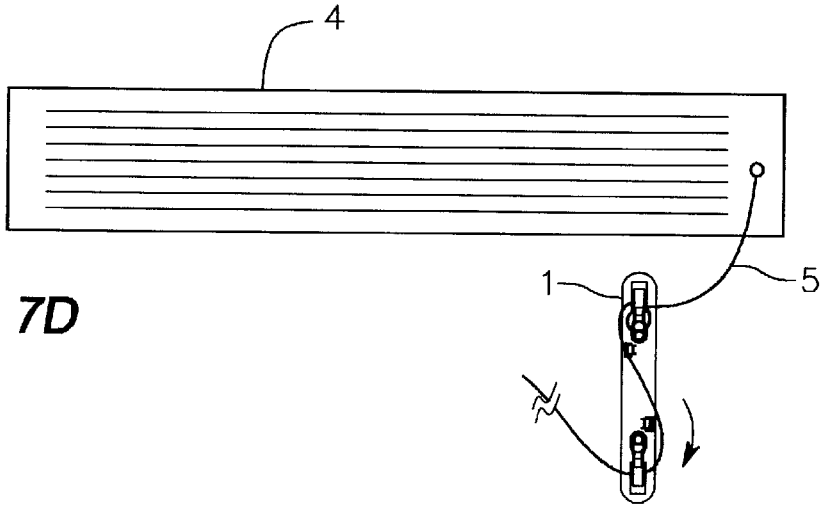
Figure 7E:
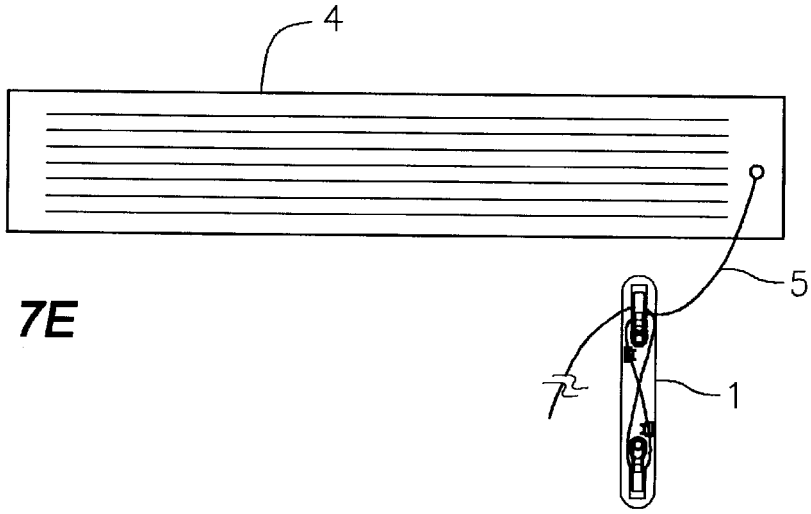

Referring now to FIG. 6, the recess for the suction cup openings is illustrated. A recess 25 is located in the base 12 such that the material in the area of the suction cup openings is thinner than the remainder of the base 12 and allows the groove located on the suction cup on the opposite side from the cup itself, to be placed inside the suction cup openings. Referring now to FIG. 7, the operation of the preferred embodiment of the device will be described. In order to install the device, the consumer will typically raise a shade or blind 4 to expose the window panes. Next, the suction cups 14 are attached to the device base 12 by inserting the groove of the suction cup 23 through the larger suction cup opening 19. The consumer then slides the suction cup into the smaller suction cup opening 18 by way of the suction cup groove 23. The device 1 including the device base and suction cups is pressed onto the glass so that the device is preferably vertically aligned with the window. This vertical alignment is primarily to achieve a pleasing appearance. The device will work in any orientation. The device should be placed on the same side of the window as the cord 5 and must be placed high enough as to be out of the reach of children. Then, the excess cord is simply wrapped firmly once around one of the cleats, preferably the upper cleat, then through one of the side clips, preferably the upper side clip, and then in a FIG. 8 fashion firmly around both cleats until the excess cord is wrapped onto the device. The cord is properly secured when wrapped through the single upper side clip. The second side clip is provided for added security and so that the cord could end on either side of the cleats. FIG. 5(*b*) illustrates a counterclockwise rotation around the top cleat, but either cleat may be used, and the wrapping may proceed in either a clockwise or counterclockwise manner. By wrapping the cord around one of the side clips before beginning the FIG. 8 pattern, the cord will not become unwrapped if the device becomes separated from the window. If only a FIG. 8 pattern is used to wrap the cord, then it is possible for the device to fall and unwrap the cord if it becomes separated from the window. This preferred procedure can be accomplished with one hand.

Alternatively, the cord 5 may be wrapped around the device before the device is attached to the window. In this case, however, two hands are generally required- one to hold the device, and one to wrap the cord around the device.

In this preferred embodiment, a number of advantages of the tie-down device become evident. The preferred clear materials will produce a generally transparent device which is relatively obscure and which will not clash with the room decor. The suction cups allow for installation of the device to a window without the use of tools. The suction cups allow the device to be easily removed and stored, or to be moved from one window to another throughout the house as needed. The consumer can easily take the devices with them if they change residences. The tie-down device allows the consumer to easily wrap the cords rather than tie or clip them which could cause damage to the cords. Cords wrapped properly around the tie-down device appear clean and uniform rather than balled up or tangled.

To remove the mechanism the consumer pulls each suction cup 14 using the release tab 17 and the device 1 is removed. Alternatively, the consumer may simply press the release tab 17 inward toward the base 12. This movement releases the suction cup from the window pane. The flange release operation should be repeated for the second suction cup.

The preferred method of retaining a cord is to provide two relatively fixed cleats which provide a device to facilitate the wrapping of the cord and the storage of the cord. There are many equivalent structures to the cleats including simple posts, angled pegs, brackets, and capped-post structures where the cap prevents the cord from slipping off the posts.

EXAMPLE-Knobbed Assembly of Suction Cup

Figure 8:
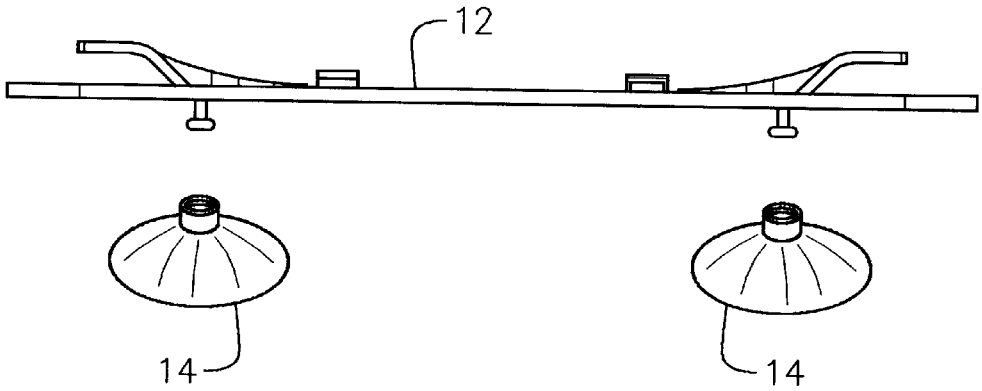
FIG. 8 is an exploded view of an alternate suction cup attachment means.

FIG. 8 shows an exploded view of an alternative means of attaching one or more suction cups to the base. In this embodiment, a knob 20 is formed on the base at the point where a suction cup is to be mounted. In this embodiment, the consumer is instructed to place the suction cup over the knob.

EXAMPLE-Large Roll

Figure 9A:
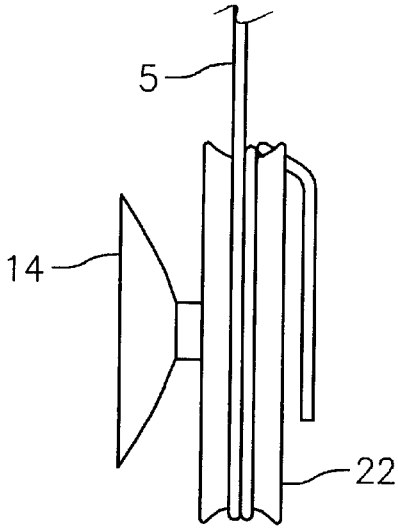
FIG. 9A is a side view of a single large support embodiment.
Figure 9B:
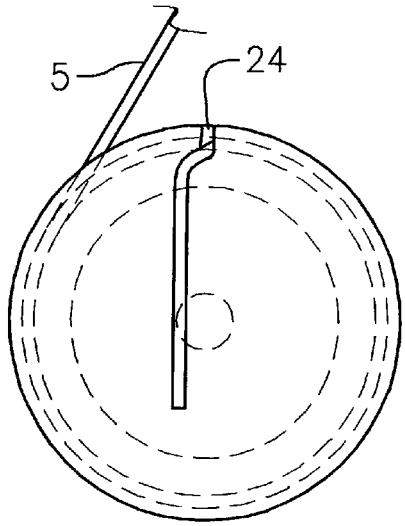
FIG. 9B is a front view of a single large support embodiment.

FIG. 9 shows a side view of an alternative embodiment wherein a relatively large diameter support such as a spool 22 is used to provide a place to wrap the cord. Preferably the support will be large enough that a relatively few revolutions may capture the excess cord. The optimum size of this embodiment is likely to be a diameter such that the excess cord may be captured in about 10 revolutions or less. The required diameter of the device would be approximated by the relationship:

Required diameter=Maximum Excess cord length/(Desired maximum revolutions * Pi) For a relatively large window, such as a 5-foot high window, almost five feet of extra cord may be present when the window covering is raised. To capture that length of cord in 10 revolutions or less, a device diameter of about two inches is required.

In order to prevent the cord from unwrapping if the device becomes detached from the window, the spool will preferably have a slot 24 or a tab to accept the end of the cord to prevent the unwinding of the cord in the event that the device becomes separated from the window.

EXAMPLE-Adjustable Length

Figure 10:
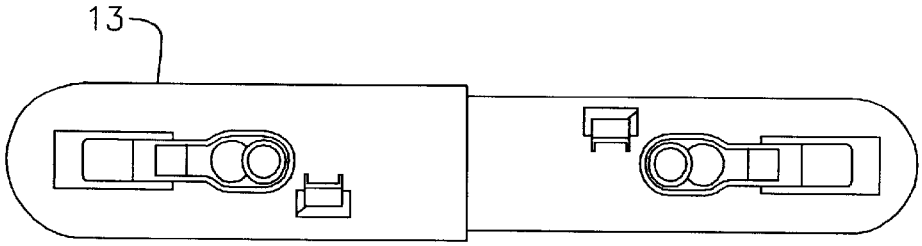
FIG. 10 is a top view of an adjustable length embodiment.

FIG. 10 shows a top view of an alternative embodiment with an adjustable base 13 where the distance between the cleats 10 can be increased to accommodate longer cord.

EXAMPLE-Cord Hanging Support

Figure 11A:
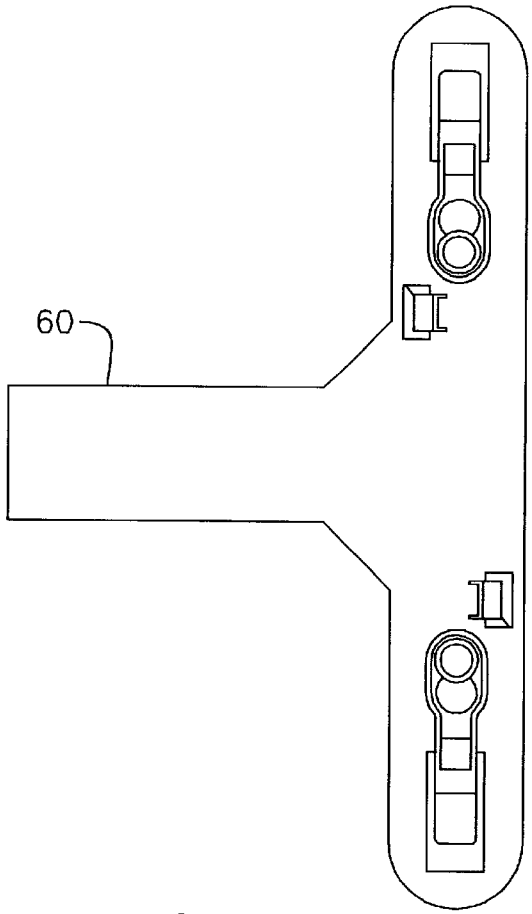
FIG. 11A is a view of a non-attached cord wrap with a handle.
Figure 11B:
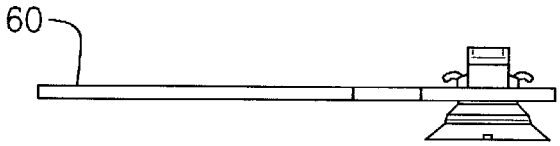
FIG. 11B is a side view of a non-attached cord wrap with a handle.

FIGS. 11A and 11B show a top view and a side view of an alternative embodiment which is not mounted to the glass or window frame. In this embodiment, the device may be held by its handle 60 while the cord is wrapped around the cleats 10. If the wrapping procedure described in the preferred embodiment is followed, then the cord will be held in place after the handle is released. The cord may be unwrapped by grasping the handle and unwinding the cord.

What is claimed is:

1. A device to support a window covering cord, the device comprising a flat base adaptive for attachment to a window pane having a top surface and a bottom surface, the base having a first slot and a second slot, each slot extending from the top surface of the base to the bottom surface of the base, a first cleat integral to the top surface, a second cleat integral to the top surface, such that the cord may be wrapped around the first cleat and second cleat, and at least one side clip integral to the top surface, such that a portion of the cord may be secured within the side clip;

a first detachable suction cup having a stem such that the stern may be inserted into the first slot so that the first suction cup may be mounted on the bottom surface of the base; and a second detachable suction cup having a stem such that the stem may be inserted into the second slot so that the second suction cup may be mounted on the bottom surface of the base.

2. The device of claim 1 wherein stem of the first suction cup is grooved; and the stem of the second suction cup is grooved.

3. A device to support a window covering cord, the device comprising a flat base adaptive for attachment to a window pane having a top surface and a bottom surface, the base having a first cleat integral to the top surface, a second cleat integral to the top surface, such that the cord may be wrapped around the first cleat and second cleat, at least one side clip integral to the top surface, such that a portion of the cord may be secured within the side clip, a first suction cup mounting means integral to the bottom surface, and a second suction cup mounting means integral to the bottom surface;

a first suction cup mounted on the first suction cup mounting means; and a second suction cup mounted on the second suction cup mounting means.

4. The device of claim 3 wherein the first suction cup is detachable; and the second suction cup is detachable.

* * * * *